US010985434B2

(12) United States Patent
Wagner et al.

(10) Patent No.: US 10,985,434 B2
(45) Date of Patent: Apr. 20, 2021

(54) WAVEGUIDE ASSEMBLY INCLUDING A WAVEGUIDE ELEMENT AND A CONNECTOR BODY, WHERE THE CONNECTOR BODY INCLUDES RECESSES DEFINING ELECTROMAGNETIC BAND GAP ELEMENTS THEREIN

(71) Applicant: HUBER+SUHNER AG, Herisau (CH)

(72) Inventors: Martin Wagner, Steinach (CH); Ulf Hügel, Herisau (CH); Michael Thiel, St. Gallen (CH)

(73) Assignee: HUBER+SUHNER AG, Herisau (CH)

( * ) Notice: Subject to any disclaimer, the term of this patent is extended or adjusted under 35 U.S.C. 154(b) by 0 days.

(21) Appl. No.: 16/478,354

(22) PCT Filed: Jan. 18, 2018

(86) PCT No.: PCT/EP2018/051233
§ 371 (c)(1),
(2) Date: Jul. 16, 2019

(87) PCT Pub. No.: WO2018/137997
PCT Pub. Date: Aug. 2, 2018

(65) Prior Publication Data

US 2019/0372188 A1 Dec. 5, 2019

(30) Foreign Application Priority Data

Jan. 24, 2017 (CH) ..... 00074/17

(51) Int. Cl.

| | |
|---|---|
| ***H01P 1/04*** | (2006.01) |
| ***H01P 1/02*** | (2006.01) |
| ***H01P 1/20*** | (2006.01) |
| ***H01P 5/02*** | (2006.01) |

(52) U.S. Cl.
CPC ..... *H01P 1/042* (2013.01); *H01P 1/02* (2013.01); *H01P 1/2005* (2013.01); *H01P 5/022* (2013.01)

(58) Field of Classification Search
CPC .. H01P 1/042; H01P 1/04; H01P 5/022; H01P 5/024; H01P 5/02; H01P 5/082; H01P 5/08
USPC ..... 333/254, 24 R
See application file for complete search history.

(56) References Cited

U.S. PATENT DOCUMENTS

| | | | | |
|---|---|---|---|---|
| 7,612,632 | B2 * | 11/2009 | Tanaka et al. | H01P 1/2005 333/26 |
| 2010/0033272 | A1 | 2/2010 | O'Connell et al. | |
| 2011/0057743 | A1 * | 3/2011 | Shimura et al. | H01P 5/024 333/26 |
| 2015/0194718 | A1 | 7/2015 | Kildal et al. | |

* cited by examiner

*Primary Examiner* — Benny T Lee
(74) *Attorney, Agent, or Firm* — Pauley Erickson & Swanson

(57) ABSTRACT

A waveguide assembly which includes an elongated waveguide element (1) and a connector body (2). The connector body (2) is connected to an end of the elongated waveguide element (1) and has a substantially planar bottom surface (24) and an opposing top surface (23). The connector body is made from a single piece of partially metallized dielectric. The connector body has a waveguide coupling element (21) adjacent to the elongated waveguide element (1). The connector body further has an arrangement of electromagnetic band gap elements (27) adjacent to the waveguide coupling element (21).

20 Claims, 5 Drawing Sheets

WAVEGUIDE ASSEMBLY INCLUDING A WAVEGUIDE ELEMENT AND A CONNECTOR BODY, WHERE THE CONNECTOR BODY INCLUDES RECESSES DEFINING ELECTROMAGNETIC BAND GAP ELEMENTS THEREIN

BACKGROUND OF THE INVENTION

Field of the Invention

The present invention lies in the field of high frequency and waveguide technology. More particularly the invention lies in the field of waveguide assemblies and methods for electromagnetic signal transmission and coupling of high-frequency components.

Discussion of Related Art

In the field of high frequency technology, a need exists for interconnecting different components, such as PCBs (printed circuit boards) with other PCBs or antennas. Typically, such interconnections are realized via coaxial cables with corresponding soldered connectors. This solution, however, requires a number of components and delicate handling steps, including soldering, and is accordingly comparatively complex and expensive. Further, the center conductor of the coaxial cables causes significant losses.

As an alternative to galvanic interconnections via coaxial cables, flexible waveguide cables exist for interconnecting purposes. The attachment of the waveguide terminations to the ends of the waveguide cables, however, is highly critical and requires precise and careful handling of a number of components. Particularly, waveguides formed from a solid dielectric core (most waveguides are hollow metal tubes) with only a thin (and so brittle) metallization make a reliable mechanical connection difficult.

SUMMARY OF THE INVENTION

It is one overall objective of the present invention to improve the interconnection of high frequency components. Favorably, the drawbacks of the prior art are fully or partly overcome by this invention. Particular advantages and favorable properties that are associated with all or some embodiments will become more readily apparent as the description proceeds. According to an aspect of the invention, the overall objective is achieved by a waveguide assembly. The waveguide assembly includes an elongated waveguide element and a connector body. The connector body is connected to an end of the waveguide element. The connector body has a planar or substantially planar bottom surface and an opposing top surface, and is made from a single piece of partially metallized dielectric. The connector body has a waveguide coupling element adjacent to the waveguide element. The connector body further includes an arrangement of electromagnetic band gap elements. The arrangement of electromagnetic band gap elements is arranged adjacent to the waveguide coupling element. The electromagnetic band gap elements are typically of identical design.

The arrangement of electromagnetic band gap elements is realized by way of three-dimensional structuring of the connector body that results in the top surface being not continuously planar. In an operational configuration, the bottom surface of the connector body is attached to or mounted on a counter-surface of a further high-frequency device, for example a printed circuit board (PCB) or an area antenna, with an integrated waveguide.

The waveguide coupling element is the part of the connector body to which the end of the elongated waveguide element is connected. The waveguide coupling element is a solid part of the connector body and extends from the elongated waveguide element to the bottom surface.

The waveguide coupling element operatively couples the elongated waveguide element with a further waveguide of a further high-frequency device, thus enabling a bidirectional signal transmission. The electromagnetic waves travel through the dielectric of the waveguide coupling element, with the arrangement of electromagnetic band gap elements preventing an undesired lateral wave propagation, which would result in losses. Through the arrangement of electromagnetic band gap elements being adjacent to the waveguide coupling element, the waveguide coupling element is, in a top view, at least partially surrounded by the electromagnetic band gap elements. The top view is a view on the top surface with a viewing direction towards the bottom surface. With exception of the bottom surface, the waveguide coupling element is metallized.

A waveguide assembly, and in particular the connector body in accordance with the present disclosure, may be efficiently manufactured in large-scale and at low costs because of a design from a single piece of plastic that serves as dielectric. As will be explained in more detail further below, the connector body may be connected to a further component, such as a PCB by way of a number of different technologies, in particular a number of technologies that do not require soldering. It is further found that an electromagnetic band gap structure with an arrangement of electromagnetic band gap elements allows comparatively large tolerances in combination with low signal degradation and good shielding performance.

A waveguide assembly in accordance with the present disclosure may favorably be used in a frequency range of 1 GHz to 250 GHz, e.g., 60 GHz. Favorably, the design of the connector body, and in particular the specific design and dimensioning of the electromagnetic band gap elements, is optimized for a desired target frequency by way of numerical simulation and trials.

Ideally, the number of electromagnetic band gap elements should be as high as possible. For practical purposes, the number of electromagnetic band gap elements may be in a range of, e.g., 8 to 40, typically in an arrangement as described further below. It is noted that the footprint (bottom view) of the connector body, and therefore the lateral area that is occupied on the counter-surface, e.g., of a PCB, increase with the number of electromagnetic band gap elements, as will be understood as the description proceeds. In particular, in the attachment area of the elongated waveguide element, a number of electromagnetic band gap elements may not be complete, but partly cut away.

The connector body may, for example, be shaped as a box or disk having a rectangular footprint with generally parallel top and bottom surfaces and a height that is smaller than the sides of the box. The sides of the footprint may have a length in a range of 3 mm to 8 mm, and the height may be in the range of 0.5 mm to 1.5 mm. For example, the footprint may be 6.2 mm×4.4 mm or 4.35 mm×3.5 mm, with a height of 0.8 mm for an application at a frequency of about 60 GHz. Generally, the dimensions may scale linearly with the wavelength, i.e., reciprocal with the frequency, resulting in considerably larger dimensions at comparatively low frequencies of, e.g., few GHz. Even though the top surface and the bottom surface are generally parallel, the waveguide coupling element may project above the top surface in some embodiments.

The connector body and optionally the elongated waveguide element, as explained below, are favorably realized by way of injection molding or 3D printing. Plastic materials may be used as dielectric, in particular a variety of thermoplastic materials, such as polytetrafluorethylene (PTFE), polyolefin, polyethylene (PE), polypropylene (PP), polyether ether ketone (PEEK), or liquid-crystal polymer (LCP).

For the partial metallization, a number of metals such as silver (Ag), copper (Cu), aluminum (Al), or gold (Au) may be used. Because of the skin effect, the metallization may be comparatively thin, such as 1 micrometer (1 μm) or below.

In some embodiments, an additional non-conductive insulation coating is provided that covers the metallization and prevents potential short circuits to other components.

In an embodiment, the electromagnetic band gap elements are recesses. The recesses extend in the connector body from the top surface towards the bottom surface.

The recesses of the electromagnetic band gap elements extend from and open into the top surface, resulting in the top surface being non-planar and recessed. The recesses extend towards the bottom surface, but have a depth that is smaller than the distance between top surface and bottom surface, resulting in the bottom surface being continuous, without recesses. Typically, the cross section of the recesses is constant along the extension from the top surface towards the bottom surface. Typically, the design and dimensioning of the recesses are identical for all electromagnetic band gap elements. Further typically, the recess has a flat or planar ground. Typically, the recesses are arranged side-by-side. The recesses are separate from each other, and are separated by metalized dielectric. Like the top surfaces (between the recesses), the circumferential shell surface and the ground of the recesses are metallized. The metalized dielectric that is present between the recesses forms a waveguide structure which is complementary to the recesses. In an embodiment, the recesses extend parallel to each other.

In some embodiments with recesses, the recesses have either a square, circular, or cross-shaped cross section. When manufacturing a connector body in accordance with the present disclosure via injection molding, the recesses of the connector body are negative elements corresponding to positive elements of the mold.

A circular cross section, corresponding to a cylindrical shape of the recesses, accordingly requires an arrangement of corresponding spaced-apart pins or posts as part of the mold, which is unfavorable from a manufacturing point of view. Therefore, the mold may instead be formed by an arrangement of drilled holes which are subsequently interconnected, e.g., by milling, thereby forming a continuous negative structure in the mold. The remaining material of the mold forms the recesses of the injection-molded connector body. The negative structure of the mold defines the above-mentioned waveguide structure of the connector body. This structure may be considered as a number of pillars that are interconnected by link elements. In such arrangement, the link elements separate neighboring recesses in both lateral dimensions of the connector body. Consequently, two link elements extend from each pillar in both lateral directions.

Typically, the recesses have a constant cross section along the extension direction thereof, which, however, is not essential. Since the recesses are complementary to the pillars and link elements, the link elements may also have a constant cross section. In some embodiment with recesses, the recesses are arranged in a pattern of rows and columns that are typically equally distant. The distance in both lateral dimensions may be measured by the center distance thereof, which also corresponds to the center distance of the pillars. The recesses are accordingly arranged in a matrix with the rows and columns of the matrix corresponding to two (generally perpendicular) lateral extension directions of the connector body.

In some embodiments with recesses, the recesses extend perpendicular to the bottom surface. The same may hold true for the pillars and link elements as complementary structure to the recesses. For an overall design of the connector body with parallel top and bottom surfaces, the pillars link elements and recesses accordingly, also extending perpendicular to the top surface.

In an embodiment, the elongated waveguide element is made from metallized dielectric. The elongated waveguide element may, in particular, be made from the same material as the connector body, and may be formed fully or partly integral with the connector body, and may favorably have a common metallization. For this type of embodiment, the end of the elongated waveguide element continuously extends into the waveguide coupling element of the connector body. The elongated waveguide element and the connector body may be formed in common and in a single step, typically by way of injection molding, but also, for example, 3-D printing. Generally, the elongated waveguide element may be planar, but may also be spatially curved or bent in accordance with the specific application requirements.

In an alternative embodiment, the elongated waveguide element is produced separately from the connector body, e.g., from the same or a different type of dielectric and attached to the connector body in a way that allows for an electromagnetic wave transition, for example by gluing. Where the connector body and the elongated waveguide element are manufactured separately, the same manufacturing technologies as mentioned before may be used for either of the single parts, and in particular for the connector body.

In an embodiment, the connector body is fully metallized with exception of the bottom surface. The bottom surface where the connector body is, in an operational configuration, attached to the counter surface, is not metallized in order to allow transition of the electromagnetic waves. Some (non-functional) areas of the bottom surface, that is, areas laterally remote from the electromagnetic wave transition, may optionally be metallized if desired.

In particular, in the attachment area of the elongated waveguide element, a number of electromagnetic band gap elements may be omitted. Furthermore, some band gap elements may be partly cut away.

In an embodiment, the elongated waveguide element is connected to the connector body such that the elongated waveguide element projects perpendicular to the bottom surface and/or the top surface. Regarding the electromagnetic signal coupling, this type of design is particularly favorable for allowing the electromagnetic coupling to be fully surrounded by electromagnetic band gap elements. Favorably, the arrangement is symmetric with the waveguide coupling element being arranged in a center region of the top surface. The favorable electromagnetic properties for this type of design, however, are associated with a considerable space consumption, in particular, in height direction. This type of design is particularly suited where space consumption is uncritical, or for coupling together, for example, two parallel PCBs.

In another embodiment, the end of the elongated waveguide element is connected to the connector body such that the elongated waveguide element projects perpendicular from a circumferential side or shell surface of the connector body. The elongated waveguide element projects from the connector body tangential to the bottom surface and/or top surface. The circumferential side surface connects the top surface and the bottom surface. For this type of embodiment, the waveguide coupling element extends to a side surface of the connector body. Regarding the electromagnetic signal coupling, this type of embodiment is generally somewhat less favorable due to not allowing the connection area between the elongated waveguide element and connector assembly to be fully surrounded by electromagnetic band gap elements. Regarding the space consumption, however this type of embodiment is favorable in a number of applications. This type of embodiment allows a particularly flat design with the overall height not extending the height of the connector body. The elongated waveguide element may, in a typical arrangement, contact the side surface in a perpendicular manner A center line or symmetry axis of the elongated waveguide element is favorably aligned with a symmetry axis of the connector body. Favorably, three sides of the waveguide coupling element are adjacent to the electromagnetic band gap structure.

In an embodiment, the waveguide assembly further includes an arrangement of elongated fixation elements. The elongated fixation elements project from the bottom surface. The elongated fixation elements may, for example be post-shaped snap fit elements for establishing a snap fit connection with a further high-frequency device, for example a PCB or an antenna. Alternatively to snap fit elements, plastically deformable post-shaped elements may be used that deform plastically upon assembly into a corresponding hole of the further high-frequency device as the counter-element. What is, in any case, required in this regard is a stable areal contact for a smooth electromagnetic wave transition. By way of example, an elongated fixation element may be arranged in each corner for a rectangular footprint. In alternative designs, the arrangement of fixation elements may be reversed and the connector body may have blind or through holes that engage, upon assembly, with elongated fixation elements projecting from the further high-frequency device. In an embodiment, the waveguide assembly further includes a non-conductive adhesive element. The non-conductive adhesive element covers at least part of the bottom surface. In some embodiments, the non-conductive adhesive element covers the whole or substantially the whole bottom surface. The adhesive element may, for example, be realized by an adhesive, typically double-sided adhesive, sheet or foil. Alternatively, the adhesive element may be realized as an adhesive coating of the bottom surface. In operation, the electromagnetic waves pass through the adhesive element when transiting from the connector body to the further high-frequency device or vice versa. If desired, a non-conductive adhesive element may be provided in addition to further fixation means, such as elongated fixation elements, as described before.

Further ways of connecting the connector body with the further high-frequency device may be used as well, alternatively or additionally to the before-mentioned arrangements. In an embodiment, the connector body is pressed with the bottom surface against the counter-surface of the further high-frequency device by way of clamping and/or with a punch, ensuring an areal contact as explained before. Further, the connector body and the further high-frequency device may be connected by way of screwing and/or hook-and-loop fasteners, such as Velcro® hook-and-loop fasteners. If required, alignment elements such as alignment pins and/or alignment edges may be provided.

In an embodiment, the waveguide assembly further includes a conductive adhesive element. The conductive adhesive element covers an area of the bottom surface. A conductive adhesive element may in particular be used in embodiments where the elongated waveguide element is connected to the circumferential side, or shell, surface as explained before. Here, the conductive adhesive element may be arranged in an edge zone of the bottom surface such that, in a top view, the conductive adhesive element extends on the bottom surface below the connection area of elongated waveguide element and connector body. The conductive adhesive element may, for example be realized as strip of conductive adhesive tape or by selective coating. The conductive adhesive element is galvanic coupled to the metallization of the connector body.

In an embodiment, the elongated waveguide element is branched. In this way, signal distribution/splitting may be achieved. In such an embodiment, a connector body may be connected to the end of each branch or only to one or a number of branch ends. In embodiments with a number of connector bodies, all connector bodies may be of identical design or designed in accordance with different embodiments. In particular, some or all of the connector bodies may be connector bodies in accordance with the present disclosure. Typically, the elongated waveguide element is, like the connector body, made from metallized dielectric. For exclusive use as a waveguide conductor, the shell surface of the elongated waveguide conductor is fully metalized respectively metal coated. In some embodiments, the metallization is discontinuous and has, e.g., strip-shaped interruptions as non-metallized areas. Through such non-metallized areas, electromagnetic waves may exit and/or enter the elongated waveguide, thus serving as transmitting and/or receiving antenna.

In an embodiment, the waveguide assembly further includes a printed circuit board (PCB) with a board-integrated waveguide or an antenna. The bottom surface of the connector body is mounted on the printed circuit board or the antenna in a planar manner such that electromagnetic waves are guided between the elongated waveguide element and the board-integrated waveguide via the connector body.

The PCB is an additional high-frequency device as generally explained before. The board-integrated waveguide may be realized by a variety of technologies as generally known in the art, for example as Substrate Integrated Waveguides, Coplanar Waveguides (CPWG), Grounded Coplanar Waveguides (GCPWG), microstrip lines, striplines, or suspended striplines.

Through the connector body, the elongated waveguide element is operatively coupled with the board-integrated waveguide for electromagnetic signal transmission. The operative coupling is generally bi-directional.

Instead of a PCB, the further high-frequency device may be of a different type and be, for example, an array antenna with a planar counter-surface for attaching the connector body.

According to a further aspect, the overall objective is achieved by a method for electromagnetic signal transmission. The method includes transmitting the electromagnetic signal via a waveguide assembly according to any embodiment as described above and/or further below.

DETAILED DESCRIPTION OF THE INVENTION

Figure 1:
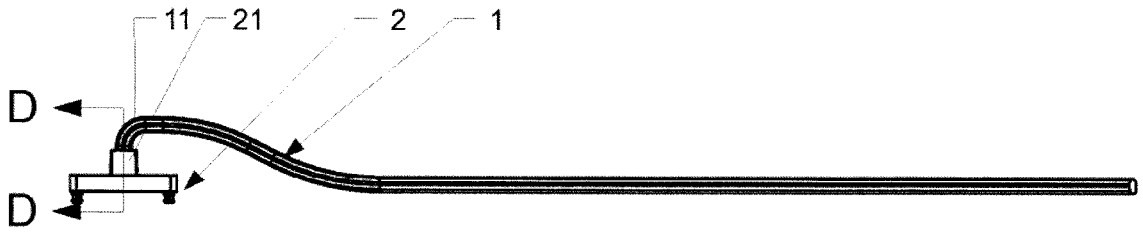
FIG. 1 shows an embodiment of a waveguide assembly in accordance with the present disclosure in a side view.
Figure 2:
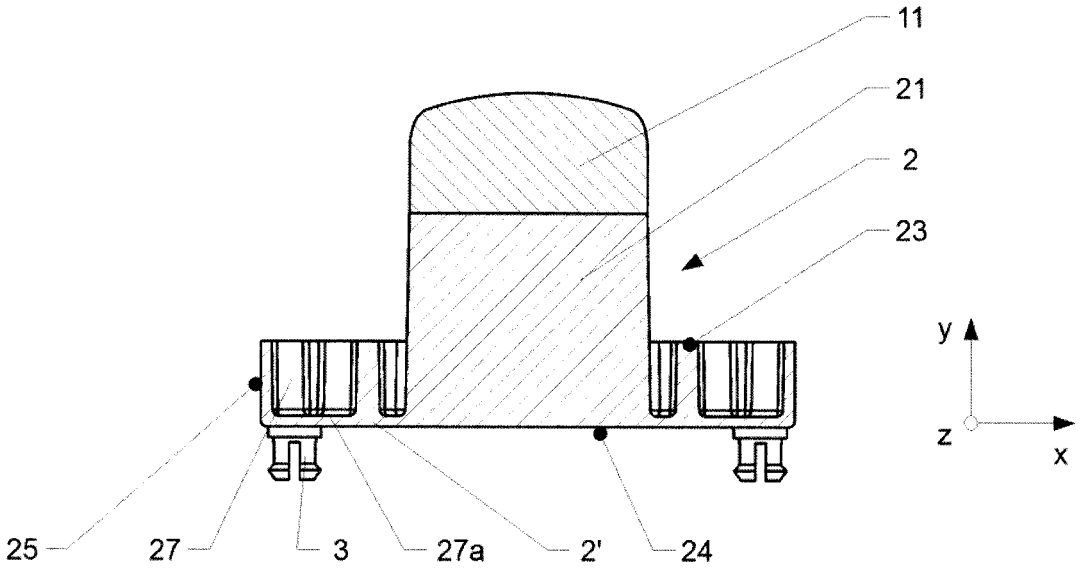
FIG. 2 shows the embodiment of FIG. 1 in a sectional view.
Figure 3:
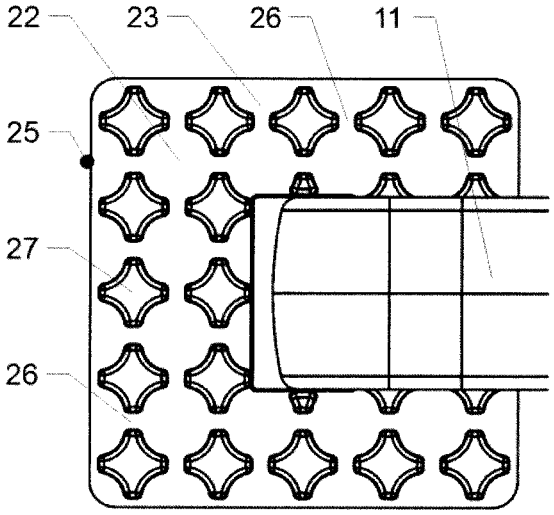
FIG. 3 shows the embodiment of FIG. 1 in a detailed top view.
Figure 4:
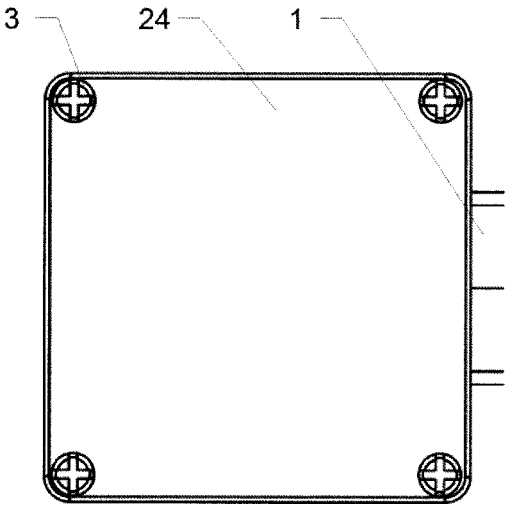
FIG. 4 shows the embodiment of FIG. 1 in a detailed bottom view.

In the following, reference is first made to FIG. 1 to FIG. 4, showing a first embodiment of a waveguide assembly in accordance with the present disclosure, where like features are denoted by the same reference labels in FIGS. 1-4. FIG. 1 shows a side view, FIG. 3 and FIG. 4 show a detailed top view respectively bottom view. FIG. 2 shows a sectional view along line D-D as indicated in FIG. 1.

Figure 6:
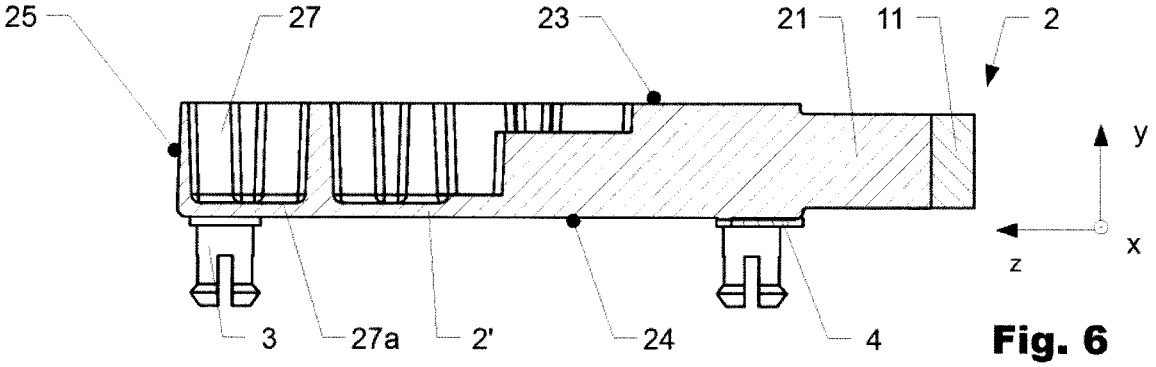
FIG. 6 shows the embodiment of FIG. 1 in a cross sectional view.

In FIG. 2, a Cartesian coordinate system (i.e., x, y, z) is shown that indicates the directions as used in the description. Similarly, a Cartesian coordinate system is shown in FIG. 6, a further embodiment as described further below. The direction from bottom to corresponds to the y-direction and the x-direction and z-direction directions that are perpendicular to the y-direction are referred to as "lateral" directions. It is noted that directional terms such as "left", "right", "top", or "bottom", "above", or "below" are intended to aid the reader's understanding and do not imply any particular orientation in a situation of use. The same holds true for the use of such terms in the summary of the invention above.

The waveguide assembly includes an elongated waveguide element 1 (shown in part) and the connector body 2. The connector body 2 substantially has the shape of a disc with square top and bottom view (FIGS. 3, 4). As best visible in FIG. 1 and FIG. 2, the connector body 2 has a waveguide coupling element 21 that is realized as solid block, extends to a bottom surface 24 and is arranged in the center of the connector body 1. The top surface of the waveguide coupling element 21 is connected to the end 11 of the elongated waveguide element 1.

As best visible in FIG. 3, the waveguide coupling element 21 is surrounded by an arrangement of electromagnetic band gap elements on all of the four sides in the top view. The electromagnetic band gap elements extend as recesses 27 of exemplary cross-shaped cross section from the top surface 23 towards the bottom surface 24. The recesses 27 are exemplarily arranged in a 5×5 matrix and equally spaced apart from each other, with the constant distance between the single rows and columns. A number of recesses in the center of the connector body 2, however, is omitted because of the waveguide coupling element 21.

The dielectric that is present between the recesses 27 forms an arrangement of pillars 22 with substantially circular cross sections, and link elements in a form of thin walls 26 that connect neighboring pillars 22 in both lateral directions.

As best visible in FIG. 2 and FIG. 6, the recesses 27 have a recess ground 27*a* above the bottom surface. Consequently, the connector body 2 has a thin, disc-shaped base part 2' from which the pillars 22 and walls 26 perpendicularly project to the top surface 23. As best visible in FIG. 3, the rows and columns of pillars 22, walls 26 and recesses are centered with respect to each other. The circumferential side surface or shell surface 25 of the connector body 2 is smooth and non-rocked respectively non-corrugated.

Figure 5:
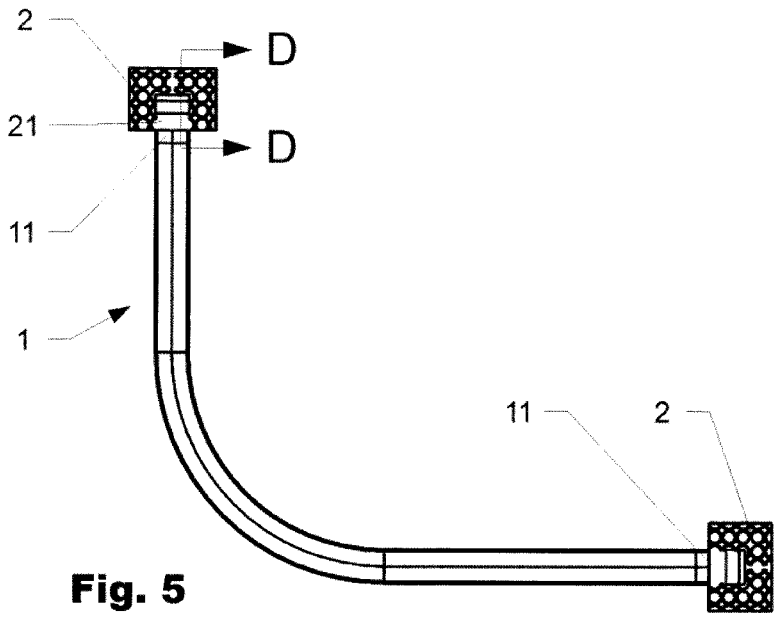
FIG. 5 shows a further embodiment of a waveguide assembly in accordance with the present disclosure in a top view.
Figure 7:
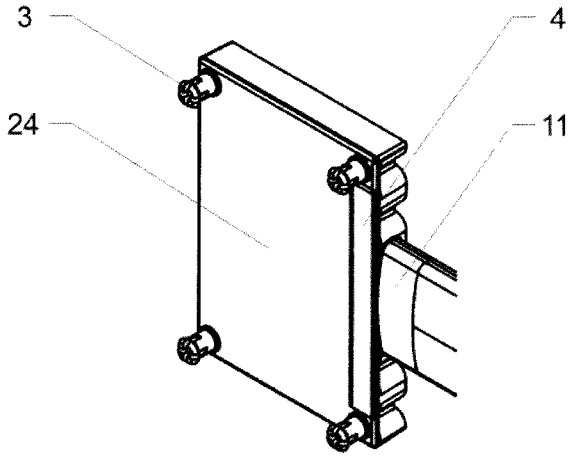
FIG. 7 shows the embodiment of FIG. 5 in a detailed perspective bottom view.
Figure 9:
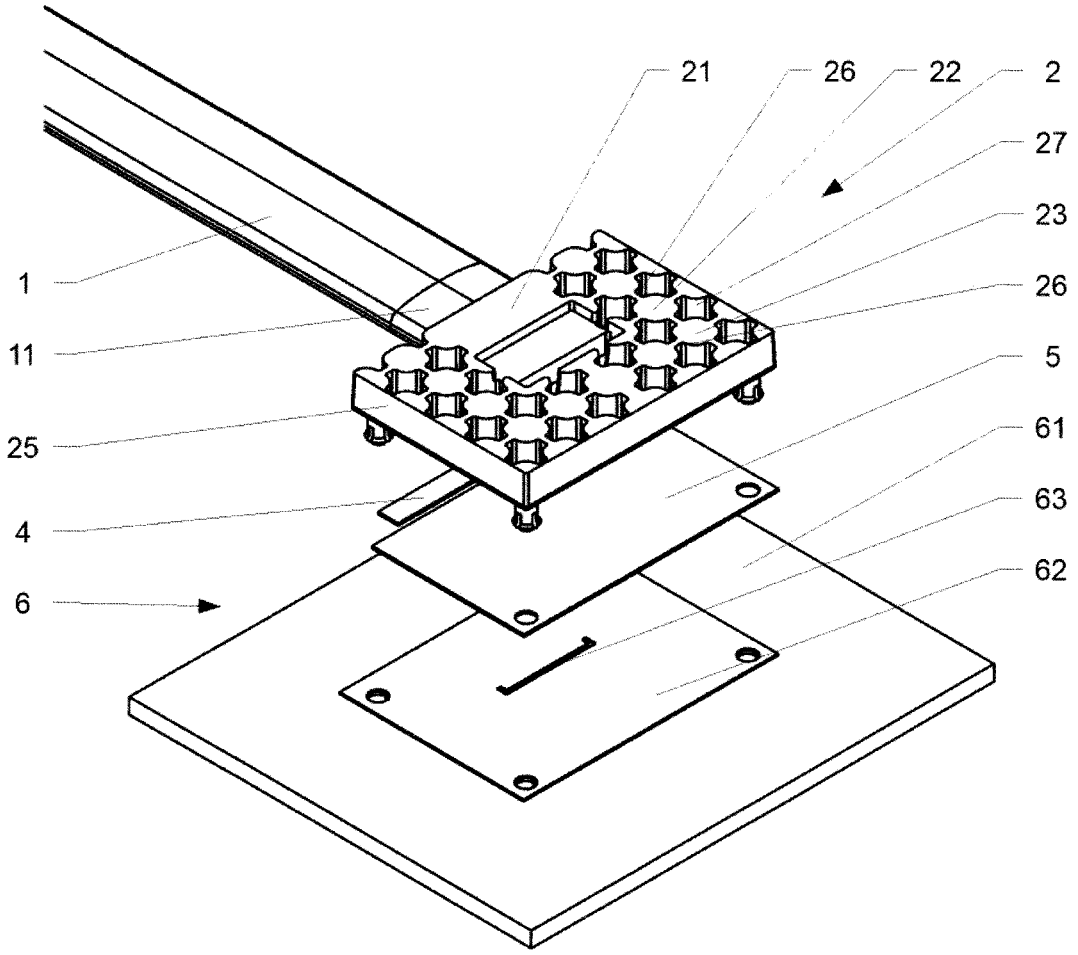
FIG. 9 shows the embodiment of FIG. 5 in a detailed exploded perspective view together with further elements.
Figure 10:
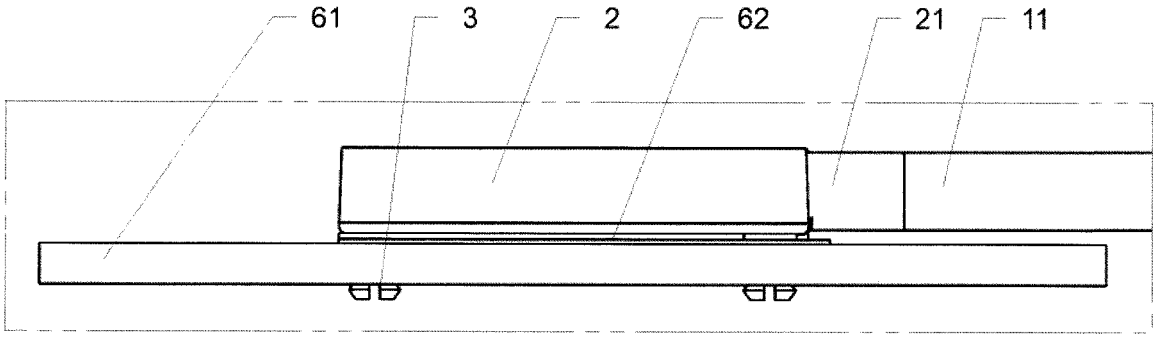
FIG. 10 shows a side view corresponding to FIG. 9.

As best visible in FIG. 2 and FIG. 4, a number of four elongated fixation elements 3 projects from the bottom surface 24, with one of the fixation elements 3 being arranged in each corner of the connector body 2. The elongated fixation elements 3 are exemplarily shown as snap fit elements that are designed to snap fit into corresponding holes or bores of a PCB as further high-frequency device (not shown), thereby establishing a tight connection with pressing contact between the bottom surface 24 and a top surface of the PCB as a counter surface. In this example, the elongated waveguide element 1 and the connector body 2 are realized from a single piece of plastic in an integral way. The end 11 of the elongated waveguide element 1 accordingly extends continuously into the waveguide coupling element 21. The connector body 2 is fully metallized except from the bottom surface 24 which is non-metallized in order to allow electromagnetic wave transition. In particular the surface of the waveguide coupling element 21 and the inner surface and grounds of the recesses 27, as well as the top surface 23 and the circumferential side surface 25 are metallized. In the following, reference is additionally made to FIGS. 5, 6, 7, and 9 and 10, showing a further embodiment of a waveguide assembly in accordance with the present disclosure, where like features are denoted by the same reference labels in FIGS. 5-10. FIG. 5 shows a top view. FIG. 6 shows a cross sectional view along line D-D as indicated in FIG. 5. FIG. 7 shows a detailed perspective bottom view of the connector body 2. FIG. 9 shows a perspective exploded view and FIG. 10 shows a detailed side view together with further elements as discussed further below.

In this embodiment, the connector body 2 is designed somewhat differently in comparison with the before-described embodiment, with the following description focusing on the differences. Further in this embodiment, a connector body 2 of identical design is exemplarily arranged at both ends 11 of the elongated waveguide element. In this embodiment, the elongated waveguide element 1, at end 11, is connected to the circumferential side surface 25. The waveguide coupling element 21 further extends to the circumferential side surface 25, such that the elongated wave guide element 1 extends continuously into the waveguide coupling element 21.

As best visible in FIG. 5 and FIG. 9, three sides of the waveguide coupling element 21 are adjacent to the electromagnetic band gap structure as explained before, with the end 11 of the elongated waveguide element 1 being connected the waveguide coupling element 21 at the remaining fourth side. As compared to the embodiment of FIG. 1 to FIG. 4, the overall design is accordingly slimmer, with the overall height being defined by the height of the connector body 2.

Because no electromagnetic band gap elements can be arranged at the side of the connector body 2 where the waveguide coupling element 21 is arranged and the elongated wave guide element 1 is connected, alternative measures are foreseen in order to ensure the desired guiding of electromagnetic waves and prevent undesired wave propagation. As seen in FIG. 6, a conductive adhesive element in form of a conductive adhesive strip 4 is arranged along an edge of the bottom surface 24 that extends below the waveguide coupling element 21. The metallization of the connector body 2 extends into the contact area with the conductive adhesive strip 4; favorably, the whole contact are is metallized in order to ensure good areal galvanic coupling with the metallization 62 (FIGS. 9 and 10). The remaining area of the bottom surface 24 that is not covered by the adhesive conductive strip 4, in contrast, is not metallized.

It is noted that instead of a conductive adhesive element, other ways of galvanic coupling may be provided. By way of example, the bottom surface 24 may be metallized in the area of the waveguide coupling element 21 and be galvanic coupled with the PCB may be established by way of a pressing contact between the bottom surface 24 and the PCB 6. Conductive spring elements between the bottom surface 24 and the PCB 6, and/or a micro structuring of the bottom surface 24 may be present in the area of the waveguide coupling element 21. In the exploded view of FIG. 9 and the side view of FIG. 10, the elongated waveguide element 1 and the connector body 2 are shown together with a PCB 6 as exemplary further high-frequency device. The PCB 6 is generally designed as known in the art, including a carrier 61 which may, e.g, be made from FR4, and a structured metallization 62 on a top surface. The structured metallization 62 includes a slit 63 which corresponds to the end of a board-integrated waveguide (not visible) as explained in the general description. The slit 63 and the end of the board-integrated waveguide are arranged in alignment and under the waveguide coupling element 21. Electromagnetic waves may accordingly exit the bottom surface of the connector body 2 respectively the waveguide coupling element 21 and enter the board-integrated waveguide via the slit 63, or the other way around. Undesired lateral wave propagation is prevented by way of the electromagnetic band gap structure and the conductive adhesive element 4.

In order to ensure a good areal contact between the bottom surface 24 of the connector body 2 and the PCB 6, respectively, metallization 62 of a non-conductive adhesive element in form of a non-conductive adhesive layer 5 is provided between the bottom surface 24 and the metallization 62. The non-conductive adhesive layer 5 has favorably the same thickness as the conductive adhesive strip 4 and bridges the gap between the bottom surface 24 and the metallization 62 that would otherwise result from the presence of the adhesive strip 4 as explained before. The non-conductive adhesive layer 5 is permeable for electromagnetic waves.

In addition, the non-conductive adhesive layer 5 serves for fixing the connector body 2 on the PCB 6, in addition to the snap fit fixation elements 3. In a variant, the snap fit fixation elements 3 may be omitted and the connector body 2 adhesively fixed on the PCB 6 only.

A PCB 6 of substantially the same design may also be used in other embodiments, for example together with a connector body as shown in FIG. 1 to FIG. 4.

Figure 8:
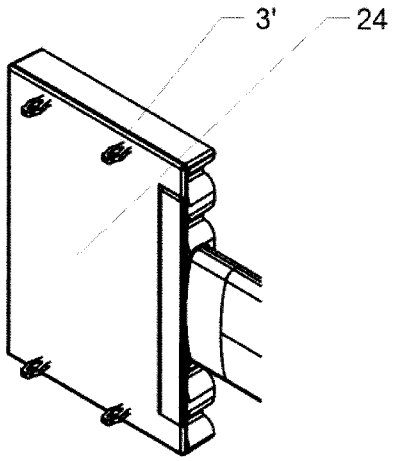
FIG. 8 shows a further embodiment of a waveguide assembly in accordance with the present disclosure in a detailed bottom view.

In the following, reference is additionally made to FIG. 8, showing a detailed perspective bottom view of the connector body 2 according to a further exemplary embodiment. This embodiment is generally similar to the before-described embodiment. In contrast to the the before-described embodiment, however, the elongated fixation elements are realized as plastically deformable posts 3' that deform plastically upon being inserted into corresponding bores of holds of a counter surface. Those plastically deformable posts 3' may also be used in other embodiments, for example the embodiment is generally shown in FIG. 1 to FIG. 4. In a variant, the posts 3' are conductive and establish the galvanic coupling of the metallization of the bottom surface 24 in the area of the waveguide coupling element, and the PCB metallization 61. Those conductive posts may replace or be present instead of the conductive adhesive strip 4 as explained before.

Figure 11:
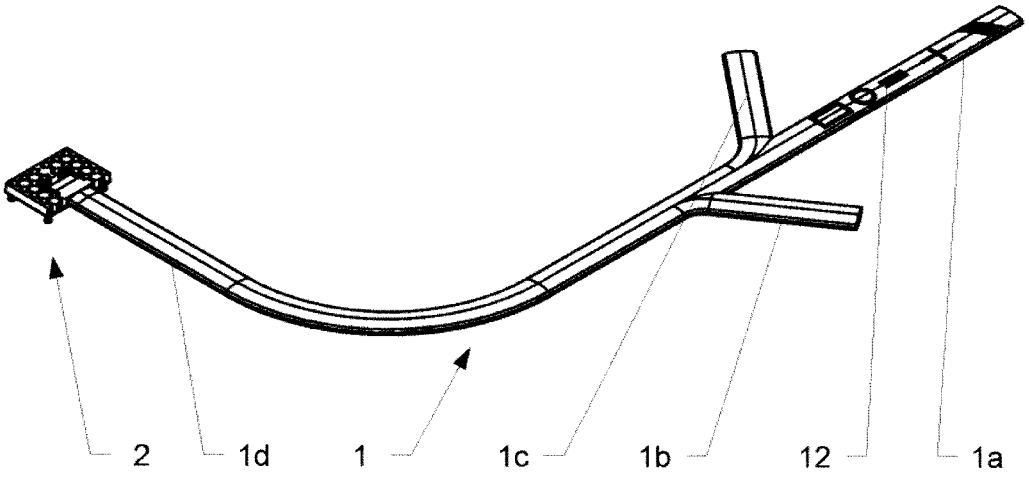
FIG. 11 shows a still further embodiment of a waveguide assembly in accordance with the present disclosure.

In the following, reference is additionally made to FIG. 11. FIG. 11 shows a still further embodiment of a waveguide assembly in accordance with the present disclosure. In the shown example, the connector body 2 is designed in accordance with FIG. 5 to FIG. 10 as discussed before. The connector body 2 may, however, also be designed in accordance with another embodiment, for example in the embodiment of FIG. 1 to FIG. 4. The embodiment of FIG. 11 differs from the before-discussed embodiment in that the elongated waveguide element 1 is branched, having four branches 1*a*, 1*b*, 1*c*, 1*d*. While only branch 1*d* is shown as connected to a connector body 2, some or all of the other branches 1*a*, 1*b*, 1*c* may also each be connected to a connector body. However, branches may also be connected to further high-frequency components in a different way. Furthermore, by way of example, the metallization (not separately referenced) of the elongated waveguide element 1 is discontinuous, with the metallization being omitted in a strip-shaped area 12 of branch 1*a*. Through the non-metallized area 12, electromagnetic waves may enter and/or except branch 1*a*, thereby serving as antenna.

Figure 12:
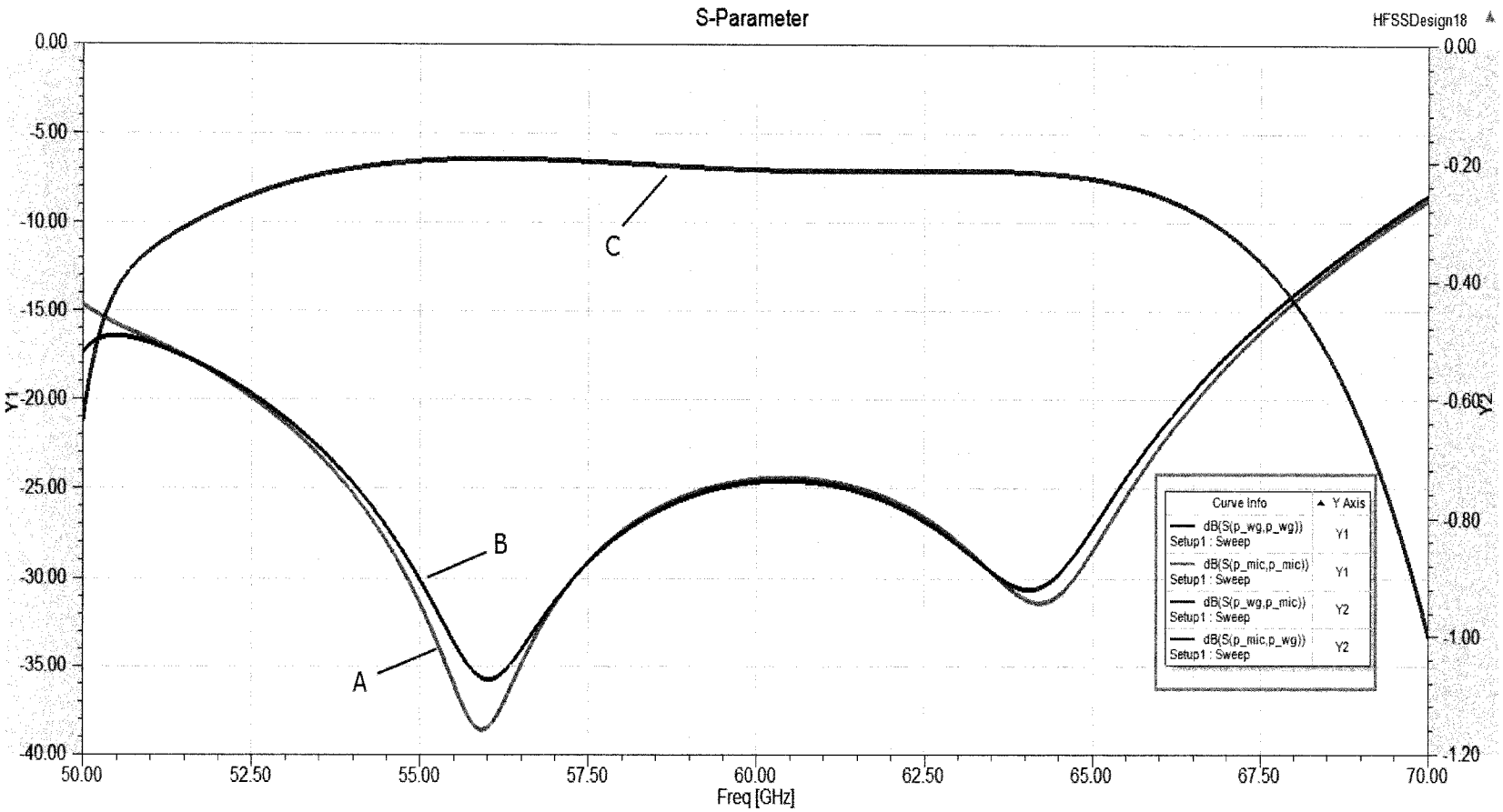
FIG. 12 exemplarily illustrates the high-frequency transmission performance of a waveguide assembly in accordance with the present disclosure.

In the following, reference is additionally made to FIG. 12. FIG. 12 exemplarily illustrates the high-frequency transmission performance (i.e. S-Parameter) of a waveguide assembly attached to a microstrip transmission line on an PCB with a slit 63 explained in FIG. 9 in accordance with the present disclosure. In FIG. 12, curves A and B show the return loss (Y1) in both directions for a frequency range (Freq[GHz]) of 50 GHz to 70 GHz with reference to the decibel scale on the left side of the diagram. Curve C shows the transmission attenuation for the same frequency rate with reference to the right scale (Y2). FIG. 12 shows that the transmission performance is good, with low loss and good match over an operational bandwidth of more than 20%. Furthermore the electrical behavior is very robust against displacement of the connector to the PCB in X, Y and Z direction.

The invention claimed is:

1. A waveguide assembly comprising: a) an elongated waveguide element; and b) a connector body, the connector body being connected to an end of the elongated waveguide element; the connector body having a substantially planar bottom surface and an opposing top surface and being made from a single piece of partially metallized dielectric; the connector body having a waveguide coupling element adjacent to the elongated waveguide element; and further an arrangement of electromagnetic band gap elements adjacent to the waveguide coupling element, wherein the electromagnetic band gap elements are recesses, the recesses extending in the connector body from the top surface towards the bottom surface.

2. The waveguide assembly according to claim 1, wherein the waveguide element is made from metallized dielectric.

3. The waveguide assembly according to claim 1, wherein all surfaces of the connector body other than the bottom surface are fully metallized.

4. A method for electromagnetic signal transmission, the method including transmitting the electromagnetic signal via a waveguide assembly according to claim 1.

5. The waveguide assembly according to claim 1, wherein the recesses have a cross-shaped cross section.

6. The waveguide assembly according to claim 1, wherein the recesses extend parallel to each other.

7. The waveguide assembly according to claim 1, wherein the recesses are arranged in a pattern of rows and columns.

8. The waveguide assembly according to claim 1, wherein the recesses extend perpendicular to the bottom surface.

9. The waveguide assembly according to claim 1, wherein the elongated waveguide element projects perpendicular from the top surface and/or the bottom surface.

10. The waveguide assembly according to claim 1, wherein the end of the elongated waveguide element is connected to a circumferential side surface of the connector body, the circumferential side surface connecting the top surface and the bottom surface.

11. The waveguide assembly according to claim 1, further including an arrangement of elongated fixation elements, the elongated fixation elements projecting from the bottom surface.

12. The waveguide assembly according to claim 1, including a non-conductive adhesive element, the non-conductive adhesive element covering at least part of the bottom surface.

13. The waveguide assembly according to claim 1, further including a conductive adhesive element, the conductive adhesive element covering an area of the bottom surface.

14. The waveguide assembly according to claim 1, wherein the elongated waveguide element is branched.

15. The waveguide assembly according to claim 1, further including a printed circuit board with a board-integrated waveguide, wherein the bottom surface of the connector body is mounted on the printed circuit board in a planar manner such that electromagnetic waves are guided between the elongated waveguide element and the board-integrated waveguide via the connector body.

16. A waveguide assembly comprising: a) an elongated waveguide element; and b) a connector body, the connector body being connected to an end of the elongated waveguide element; the connector body having a substantially planar bottom surface and an opposing top surface and being made from a single piece of partially metallized dielectric, wherein the end of the elongated waveguide element is connected to a circumferential side surface of the connector body, the circumferential side surface connecting the top surface and the bottom surface; the connector body having a waveguide coupling element adjacent to the elongated waveguide element; and further an arrangement of electromagnetic band gap elements adjacent to the waveguide coupling element.

17. The waveguide assembly according to claim 16, further including an arrangement of elongated fixation elements, the elongated fixation elements projecting from the bottom surface.

18. The waveguide assembly according to claim 16, wherein all surfaces of the connector body other than the bottom surface are fully metallized.

19. A waveguide assembly comprising: a) an elongated waveguide element, wherein the elongated waveguide element is branched; and b) a connector body, the connector body being connected to an end of the elongated waveguide element; the connector body having a substantially planar bottom surface and an opposing top surface and being made from a single piece of partially metallized dielectric; the connector body having a waveguide coupling element adjacent to the elongated waveguide element; and further an arrangement of electromagnetic band gap elements adjacent to the waveguide coupling element.

20. The waveguide assembly according to claim 19, further including an arrangement of elongated fixation elements, the elongated fixation elements projecting from the bottom surface.

* * * * *